US008043497B2

(12) United States Patent
Silverstein et al.

(10) Patent No.: US 8,043,497 B2
(45) Date of Patent: Oct. 25, 2011

(54) AESTHETIC CONDUIT END CAP STRUCTURE HAVING CONCEALED ANCHOR ATTACHMENTS

(75) Inventors: Jeffrey Silverstein, Irvine, CA (US); Frederick Desborough, Santa Ana, CA (US)

(73) Assignee: California Faucets, Inc., Huntingdon Beach, CA (US)

( * ) Notice: Subject to any disclaimer, the term of this patent is extended or adjusted under 35 U.S.C. 154(b) by 0 days.

(21) Appl. No.: 12/157,447

(22) Filed: Jun. 9, 2008

(65) Prior Publication Data

US 2008/0308476 A1 Dec. 18, 2008

Related U.S. Application Data

(60) Provisional application No. 60/933,723, filed on Jun. 7, 2007.

(51) Int. Cl.
*E03F 3/04* (2006.01)

(52) U.S. Cl. ..... 210/164; 210/232

(58) Field of Classification Search ..... None
See application file for complete search history.

(56) References Cited

U.S. PATENT DOCUMENTS

| | | | | | |
|---|---|---|---|---|---|
| 728,059 | A | * | 5/1903 | Weed | 4/287 |
| 1,375,222 | A | * | 4/1921 | Lutz | 210/163 |
| 1,580,541 | A | * | 4/1926 | Sherman | 220/210 |
| 1,721,831 | A | * | 7/1929 | Porter | 49/41 |
| 1,926,595 | A | * | 9/1933 | Mulvihill | 49/41 |
| 2,626,387 | A | * | 1/1953 | Berry | 340/573.1 |
| 2,749,999 | A | * | 6/1956 | Schmid | 210/165 |
| 2,817,274 | A | * | 12/1957 | Benoit | 49/209 |
| 2,859,452 | A | * | 11/1958 | Seewack | 210/165 |
| 3,040,895 | A | * | 6/1962 | Sisk | 210/164 |
| 3,217,619 | A | * | 11/1965 | Driver et al. | 404/25 |
| 3,319,268 | A | * | 5/1967 | Blumenkranz | 4/252.4 |
| 3,406,829 | A | * | 10/1968 | Vande Bosche | 210/164 |
| 3,420,552 | A | * | 1/1969 | Mork | 285/42 |
| 3,674,149 | A | * | 7/1972 | Donalson | 210/163 |
| 3,952,340 | A | * | 4/1976 | Cuschera | 4/252.5 |
| 4,038,789 | A | * | 8/1977 | Axgarde et al. | 52/20 |
| 4,090,267 | A | * | 5/1978 | Cuschera | 4/252.5 |

(Continued)

FOREIGN PATENT DOCUMENTS

GB 2421517 6/2006

(Continued)

OTHER PUBLICATIONS

International Search Report of Counterpart PCT Application No. PCT/US2008/007220.

(Continued)

*Primary Examiner* — Robert James Popovics
(74) *Attorney, Agent, or Firm* — Liu & Liu

(57) ABSTRACT

A conduit end cap structure (e.g., a floor drain assembly) that is securely attached to the conduit and aesthetically pleasing. The end cap of the conduit comprises a perforated plate. Anchor supports extend from the substantially concealed underside of the plate, each providing support for an anchor that is received by an anchor receiving structure on the conduit to securely attach the plate to the conduit near its opening. The anchor may be in the form of a fastener (e.g., a set screw), and the anchor receiving structure is in the form of a channel provided on the inside wall of the conduit opening. The fastener extends into the channel, thereby securely retaining the plate to prevent it from dislodging from the conduit end.

5 Claims, 9 Drawing Sheets

U.S. PATENT DOCUMENTS

| | | | | | |
|---|---|---|---|---|---|
| 4,092,745 | A | * | 6/1978 | Oropallo | 4/288 |
| 4,109,939 | A | * | 8/1978 | Roberts | 285/8 |
| 4,123,810 | A | * | 11/1978 | Oropallo | 4/288 |
| 4,146,939 | A | * | 4/1979 | Izzi | 4/286 |
| 4,257,193 | A | * | 3/1981 | Williams | 49/465 |
| 4,321,713 | A | * | 3/1982 | Thompson | 4/290 |
| RE31,561 | E | * | 4/1984 | Thompson | 4/290 |
| 4,456,397 | A | * | 6/1984 | Freis et al. | 404/25 |
| 4,470,162 | A | * | 9/1984 | Marshall | 4/252.5 |
| 4,502,166 | A | * | 3/1985 | Brown, Sr. | 4/252.5 |
| 4,655,913 | A | | 4/1987 | Boersma | |
| 4,780,915 | A | * | 11/1988 | Cuschera | 4/252.4 |
| 4,871,451 | A | * | 10/1989 | Piskula | 210/164 |
| 4,883,590 | A | | 11/1989 | Papp | |
| 4,978,250 | A | * | 12/1990 | Dallmer | 405/303 |
| 4,984,308 | A | * | 1/1991 | Handal | 4/252.6 |
| 5,154,024 | A | * | 10/1992 | Noel | 52/12 |
| 5,372,715 | A | * | 12/1994 | Maggard et al. | 210/165 |
| 5,377,361 | A | * | 1/1995 | Piskula | 4/252.4 |
| 5,628,152 | A | * | 5/1997 | Bowman | 52/20 |
| 5,878,448 | A | * | 3/1999 | Molter | 4/613 |
| 6,007,270 | A | * | 12/1999 | Bowman | 404/25 |
| 6,085,362 | A | * | 7/2000 | Huber | 4/252.4 |
| 6,085,779 | A | * | 7/2000 | Eriksson | 137/362 |
| 6,109,822 | A | * | 8/2000 | Campbell et al. | 404/25 |
| 6,344,137 | B1 | * | 2/2002 | Chiang | 210/164 |
| 6,381,775 | B1 | * | 5/2002 | Sondrup | 4/679 |
| 6,443,656 | B1 | * | 9/2002 | Gunter | 405/119 |
| 6,687,925 | B2 | * | 2/2004 | Minnick | 4/613 |
| 6,766,545 | B2 | * | 7/2004 | Hodges | 4/679 |
| 6,799,606 | B1 | | 10/2004 | Howson | |
| 6,877,451 | B2 | * | 4/2005 | Rivas | 114/182 |
| 2002/0146285 | A1 | | 10/2002 | Kincheloe | |
| 2006/0283792 | A1 | * | 12/2006 | McCallum | 210/459 |
| 2007/0034577 | A1 | * | 2/2007 | Bayard et al. | 210/767 |
| 2008/0308476 | A1 | * | 12/2008 | Silverstein et al. | 210/163 |

FOREIGN PATENT DOCUMENTS

| | | |
|---|---|---|
| WO | 02/075066 | 9/2002 |

OTHER PUBLICATIONS

Webpage for "Oatey Shower Drains", taken from Oatey's website, www.oatey.com, pp. 1-6.

Webpage for "Oatey Shower Pan Liner", taken from Oatey's website, www.oatey.com, pp. 1-2.

* cited by examiner

AESTHETIC CONDUIT END CAP STRUCTURE HAVING CONCEALED ANCHOR ATTACHMENTS

RELATED CASE

This application claims the priority of U.S. Provisional Patent Application No. 60/933,723, filed Jun. 7, 2007, which is fully incorporated by reference as if fully set forth herein.

BACKGROUND OF THE INVENTION

1. Field of the Invention

The present invention relates to capping structure at the terminating ends of ducts or conduits (e.g., floor drains), in particular capping plates having substantially concealed anchor attachment structures (e.g., a grid for capping a drain).

2. Description of Related Art

Ducts and conduits in building structures extend and terminate at openings of finished surfaces. These openings are usually covered with a capping plate. For example, a drain pipe terminates at an opening in the shower floor, which is typically covered with a perforated cover (e.g., a strainer, grid, grate, etc.) that allows liquid to flow therethrough but to prevent larger debris from entering the drain pipe. A ventilation duct terminates at an opening in the wall or floor, and the opening is typically covered by a vent plate having baffled openings to direct and distribute air out of the opening (in the case of a ventilation outlet), or by a grate that protects a filter element (in the case of a ventilation inlet). In the past, conduit covers are attached to the terminating ends of conduits by snap attachments or screw fasteners. However, snap attachments are not secure, and screw fasteners leave an unsightly appearance for covers that are exposed to view.

It is therefore desirable to provide a secure and aesthetic conduit end cap structure.

SUMMARY

The present invention provides a novel conduit end cap structure that is secure and aesthetically pleasing. In accordance with the present invention, the end cap of the conduit is provided with anchor supports that allow anchors to be used to securely attach the cap to the conduit, and that are concealed or substantially concealed from plain view squarely at the end cap.

In one embodiment of the present invention, an aesthetic end cap structure is designed for a drain assembly (e.g., a floor drain assembly). The cap structure comprises a perforated plate, which may be in the form of a strainer, grid, grate, etc. The plate has an external side that is exposed to view when installed, and an internal side that is not exposed to view when installed. One or more anchor supports extend from the internal side of the plate, each providing support for an anchor that is received by an anchor receiving structure on the conduit to securely attach the plate to the conduit near its opening. In one embodiment, the anchor is in the form of a fastener (e.g., a set screw), and the anchor receiving structure is in the form of a channel provided on the inside wall of the conduit opening. The fastener extends into the channel, thereby securely retaining the plate on the conduit to prevent it from dislodging from the conduit end.

BRIEF DESCRIPTION OF DRAWINGS

For a fuller understanding of the nature and advantages of the invention, as well as the preferred mode of use, reference should be made to the following detailed description in conjunction with the accompanying drawings. In the following drawings, like reference numerals designate like or similar parts throughout the drawings.

DESCRIPTION OF THE ILLUSTRATED EMBODIMENT

This invention has been described herein in reference to the drawings. The present description is of the best presently contemplated mode of carrying out the invention. This description is made for the purpose of illustrating the general principles of the invention and should not be taken in a limiting sense. It will be appreciated by those skilled in the art that variations and improvements may be accomplished in view of these teachings without deviating from the scope and spirit of the invention. The scope of the invention is best determined by reference to the appended claims.

The present invention provides a novel conduit end cap structure that is secure and aesthetically pleasing. In accordance with the present invention, the end cap of the conduit is provided with anchor supports that allow anchors to be used to securely attach the cap to the conduit but are substantially concealed from plain view squarely at the end cap. By way of illustration, the present invention will be described in reference to a floor drain assembly structure, for example. Other types of conduits (e.g., air ventilation conduits, etc.) may well take advantage of the benefits achieved by the present invention. Conduits include, without limitations, ducts, pipes, and other types of flow passages, etc.

In the embodiment of the present invention illustrated by the drawings, an aesthetic end cap structure is designed for a drain assembly, particularly a floor drain assembly. The cap structure comprises a perforated plate, which may be in the form of a strainer, grid, grate, etc. The plate has an external side that is exposed to view when installed, an internal side that is not exposed to view when installed. One or more anchor supports extend from the internal side of the plate, each providing support for an anchor that is received by an anchor receiving structure on the conduit to securely attach the plate to the conduit near its opening. In one embodiment, the anchor is in the form of a fastener (e.g., a set screw), and the anchor receiving structure is in the form of a channel provided on the inside wall of the conduit opening. The fastener extends into the channel, thereby securely preventing the plate from dislodging from the conduit end.

Figure 1:
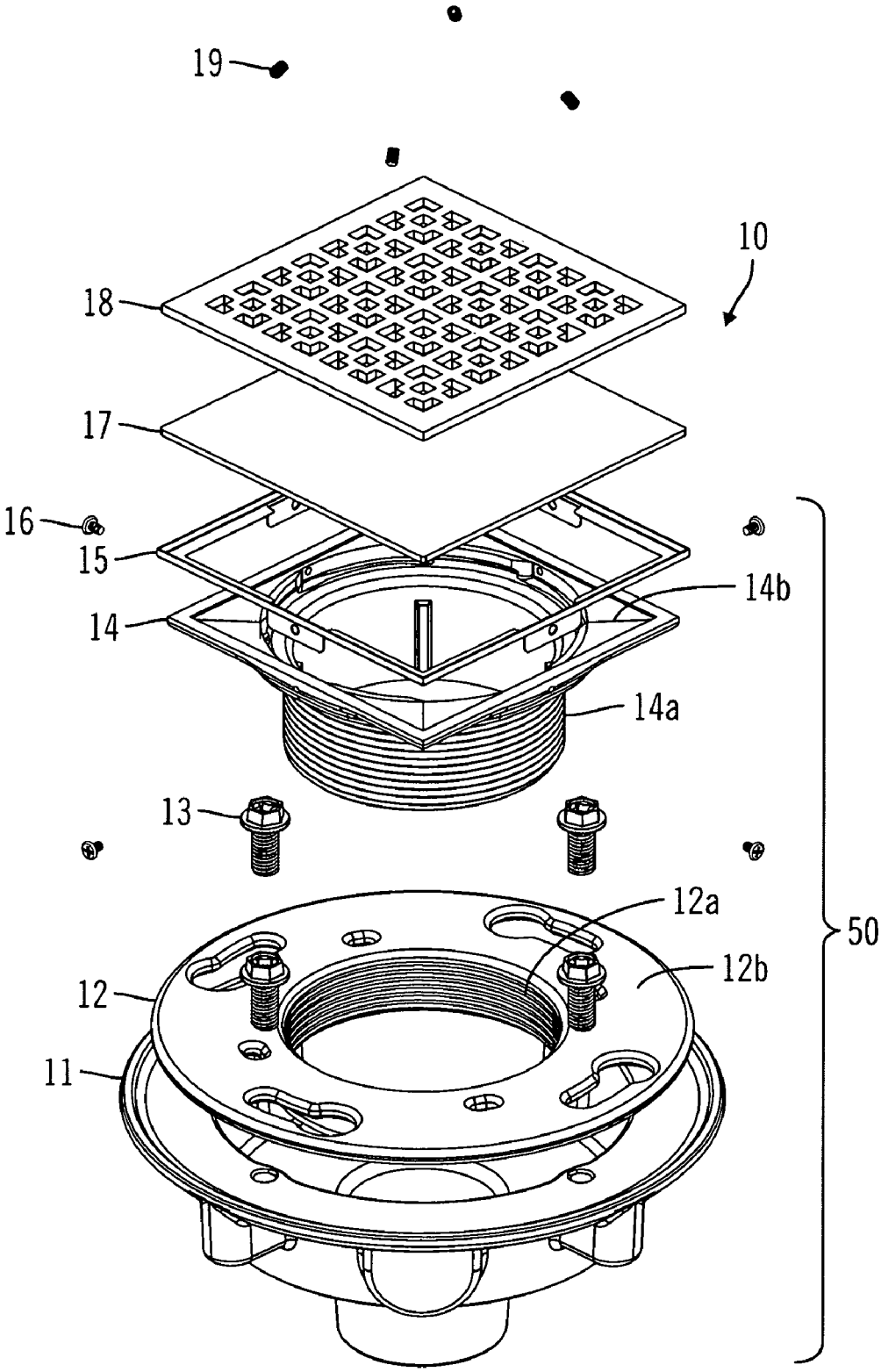
FIG. 1 is an exploded perspective view of a floor drain assembly, in accordance with one embodiment of the present invention.
Figure 2:
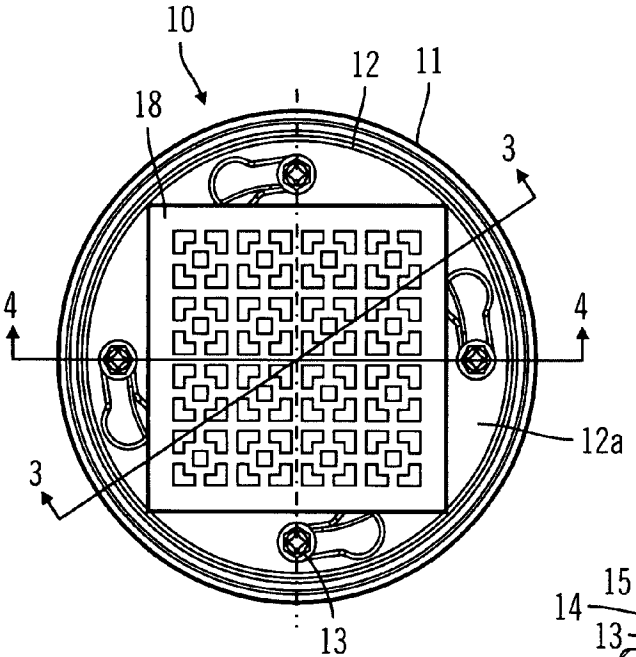
FIG. 2 is a top view of the floor drain assembly of FIG. 1.
Figure 3:
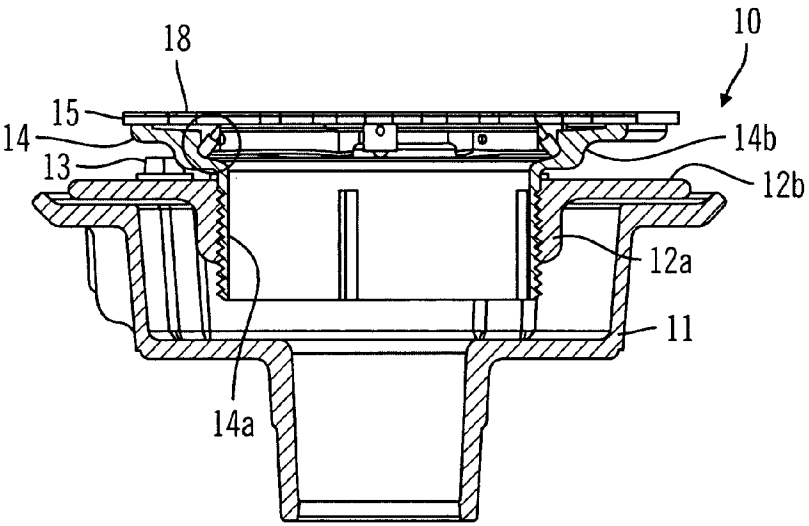
FIG. 3 is a sectional view of the floor drain assembly taken along line 3-3 in FIG. 2.
Figure 4:
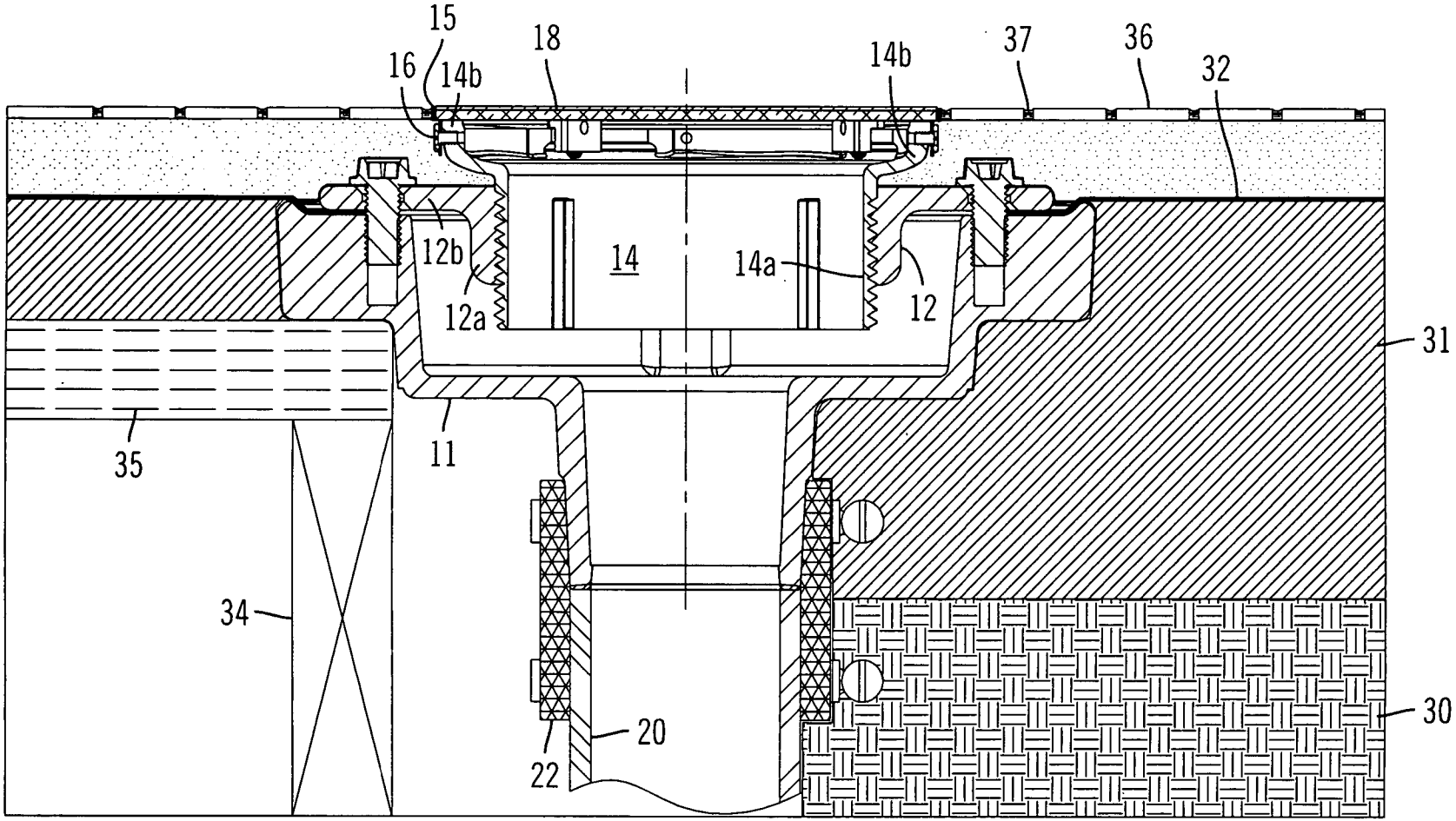
FIG. 4 is a sectional view of the floor drain assembly taken along line 4-4 in FIG. 2.

Referring to the drawings, FIG. 1 illustrates a drain assembly 10 that is suitable for applications for floor drains. In accordance with one embodiment of the present invention, the drain assembly 10 includes various components, which essentially comprises a drain sub-assembly 50 comprising sub-components/hardware for attached to a drain pipe, and a drain grid 18. With the drain assembly 10 installed in the floor, only the top surface of the drain grid 18 is exposed to view by a user. The drain sub-assembly 50 includes a drain body 11, a collar 12, bolts 13, drain throat 14, a tile frame 15, screws 16, and a mud guard 17 (which comes with the package for the assembly but not present in the final assembly as installed). FIG. 2 is a top view of the drain assembly 10 as seen with the components assembled (with the mud guard 17 not present); FIG. 3 is a sectional view of the floor drain assembly taken along line 3-3 in FIG. 2; and FIG. 4 is a sectional view of the floor drain assembly taken along line 4-4 in FIG. 2, as seen installed in a floor.

The structure of the floor or ground in which the drain assembly of the present invention is to be installed may take various forms depending on the particular application desired for the drain assembly. In the embodiment illustrated in FIG. 4, the floor may include a foundation layer 30 of dirt/earth, a concreted layer 31, a waterproof membrane 32, and a protective and/or decorative flooring layer, which may include a layer of mortar 33 and a layer of tiles 36 and grout 37. The drain assembly 10 may be further supported by a floor structure that includes a floor joist 34 and a wood sub floor 35. The particular floor/ground structure is not a part of the present invention, and may take other forms (e.g., comprising more or less layers and/or different materials for the layers) without departing from the scope and meaning of the present invention.

With the drain assembly 10 installed in the floor, the drain body 11 is connected to a drain pipe 20 in the foundation layer 30, for example, via a "NO HUB" connecting clamp 22. The "No HUB" connection allows for a quick and simple installation between the drain body 11 and the drain pipe 20 below the floor or in the ground. Other types of connection means may be used instead, such as a threaded coupler, solvent joint, welding, cement, etc. Once the drain body 11 is connected to the drain pipe 20, the coupling can be tested for leakage, then set in concrete 31 and/or supported via installation with various materials and structure, such as the floor joist 34 and wood sub floor 35. The collar 12 supports the drain throat 14. The drain throat 14 in turn supports the tile frame 15, which defines an opening in the floor surface that is not finished by tiles 36, for example. The opening so defined is covered by the grid 18 having perforations to allow drainage of fluids but strains objects that may clog the drain (or in the case for an air ventilation conduit, air is the fluid).

The collar 12 has a central cylindrical section 12*a* extending from a generally planar flange section 12*b*. The collar 12 allows for securing the waterproof membrane 32 on top of the drain body 11, by clamping the collar 12 down on the drain body 11 using the bolts 13 through holes provided in the flange section 14*b*. The drain throat 14 has a central cylindrical section 14*a*, which depends from a slightly flared flange section 14*b*. The cylindrical section 12*a* of the collar 12 has internal or female threads to accept the external or male threads provided on the cylindrical section 14*a* of the drain throat 14. This enables vertical up and down height adjustments of the drain throat 14 in relation to the floor surface, to facilitate drain throat 14 installation in conjunction with the floor, which may vary in height depending on the type of flooring materials being used (e.g. tile, granite, terrazzo or other composite materials). The collar 12 is reversible in relation to the drain body 11 (i.e., the cylindrical section 12*a* of the collar 12 extending downwards (as shown in FIG. 4) or upwards (not shown in FIG. 4) in relation to the drain body 11), to allow a larger range of height adjustments for the drain throat 14 in relation to the floor surface, without the need to otherwise allocate more materials for a longer cylindrical section 14*a* for the drain throat 14 to accommodate a larger range of height adjustments.

The drain throat 14 may vary in sizes and shapes (e.g. square, rectangular, round, oval, triangular, diamond etc.). The drain throat 14 provides anchoring for attachment of the tile frame 15 around the flange section 14*b* of the drain throat 14 using one or more screws 16 through holes provided on the side of the tile frame 15. When attached to the drain throat 14 and installed in the floor, the tile frame 15 defines a boundary to the installation of flooring materials (e.g. tile, granite, terrazzo or other composite materials) up to the tile frame 15, leaving a grout or sealing joint between the floor material and the tile frame 15. The tile frame 15 reduces the risk of damage, corrosion or unsightly appearances to the finished parts of the drain assembly 10 during or after installation. The tile frame 15 may vary in shapes and sizes (e.g. square, rectangular, round, oval, triangular, diamond etc.), according to the periphery size and shape of the flange section 14*b* of the drain throat 14, and which complements the shape and size of the drain grid 18 to be received within the periphery of the tile frame 15. The tile frame 15 can take on other features and shapes depending on the application for which it may be used. Floor drain is one application but the purpose and definition can be extended to HVAC and ventilation registers, or any fixture apertures requiring a decorative finish component such as a grid or opening cover or cap.

The mud guard 17 is provided to facilitate installation of the flooring materials (e.g. tile, granite, terrazzo or other composite materials along with the mastic or thin set or mortar etc.), which is removed after installation phase. The mud guard 17 reduces the risk of materials or debris dropping down inside the drain throat 14, which could cause blockage and/or poor drainage. The mud guard 17 may be made of plastic or tough paper material, with a self-adhesive backing for attachment to the tile frame 15. After the installation of flooring materials is complete, the mud guard 17 can easily be removed without the aid of any special tools. The mud guard 17 can vary in size and shape to fit in the tile frame 15 (e.g. square, rectangular, round, oval, triangular, diamond etc.). The mud guard 17 can be made from other metallic or non-metallic materials (e.g. aluminum, sheet metal, acrylic or other natural or synthetic materials).

Figure 5:
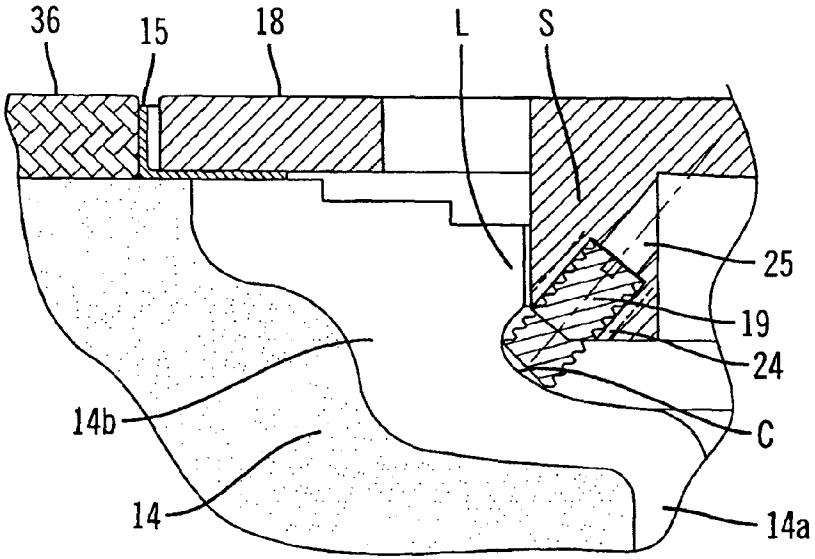
FIG. 5 is an enlarged view showing details of the anchoring of the grid to the drain throat.
Figure 7B:
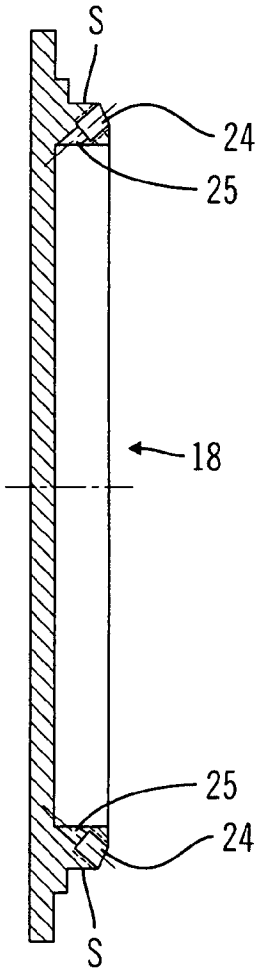
FIG. 7B is a sectional view taken along line 7B in FIG. 7A.
Figure 7A:
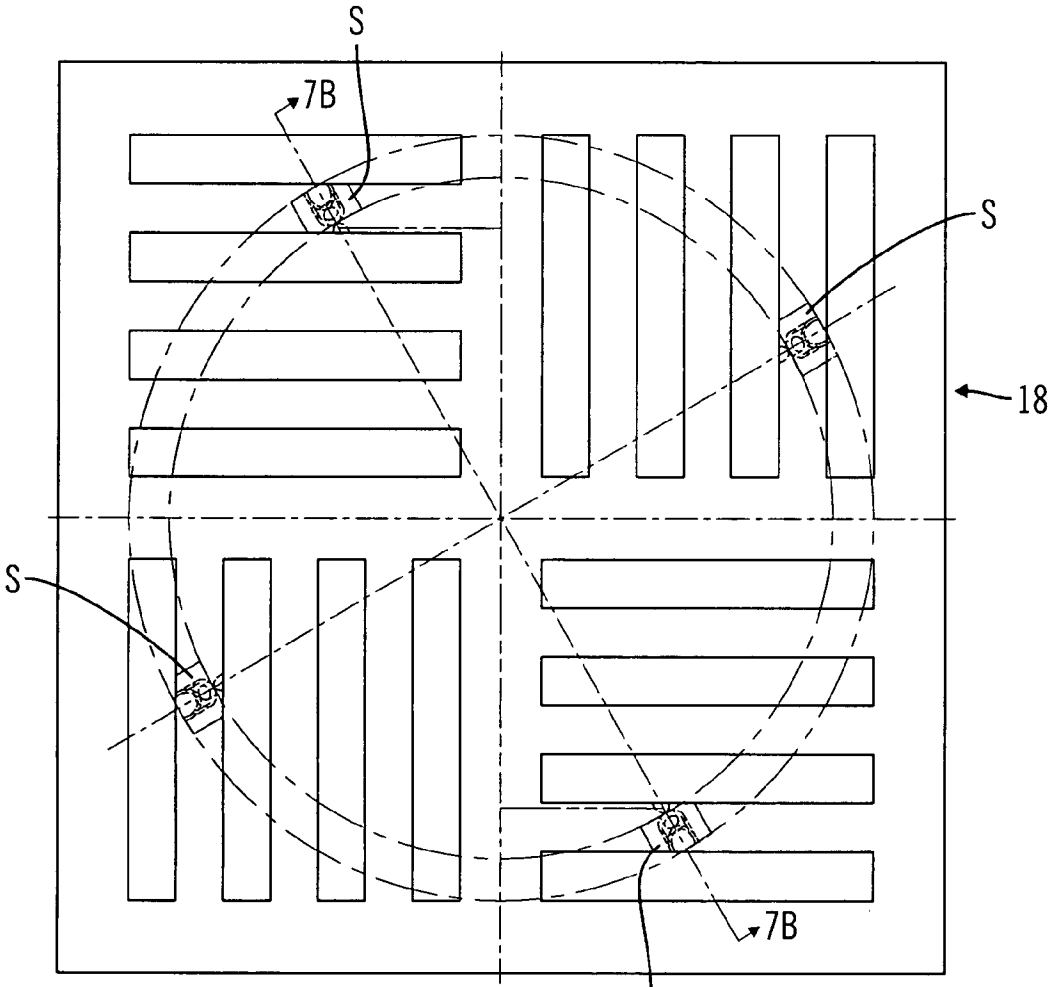
FIG. 7A is a plan view of the bottom side of a drain grid in accordance with one embodiment of the present invention.
Figure 7C:
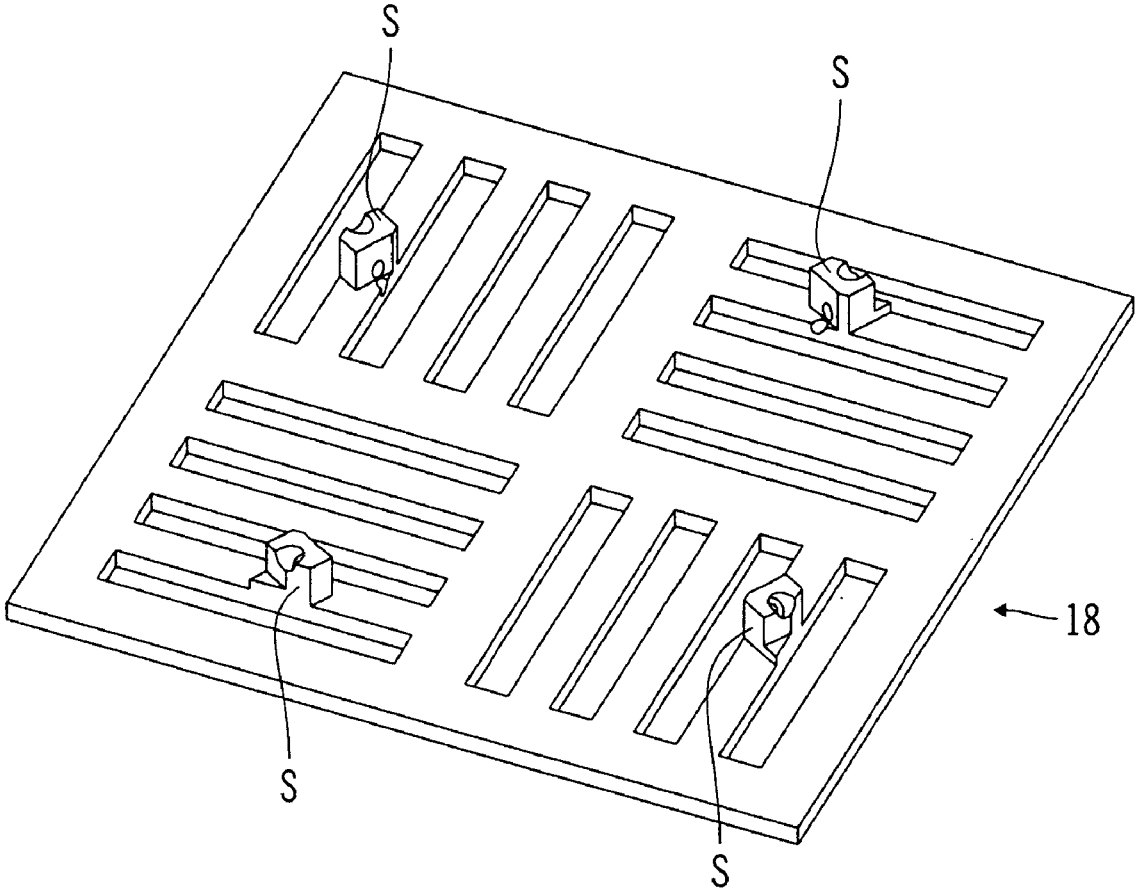
FIG. 7C is a bottom perspective view of the drain grid.

In accordance with the present invention, the drain throat 14 includes anchor receiving structures (e.g., machined areas), which facilitate the secure installation of the drain grid 18 with no visible screws. FIG. 5 is an enlarged view showing details of the anchoring of the grid 18 to the drain throat 14. The drain throat 14 has an upper flange or lip L defining a groove or channel C. Referring to FIGS. 6A-D, there are more than one lip L provided circumferentially or annularly (at even spacing or uneven spacing) about the central opening of the drain throat 14. Alternatively, the lip L may be a continuous annular or a partial annular (e.g., open-looped) structure about the central opening of the drain throat 14, with the channel C in a continuous annular or a partial annular channel. In the illustrated embodiment of FIG. 6A-D, four lips L are defined to complement the four anchor supports on the drain grid 18 shown in FIGS. 7A-B. A continuous or partially continuous channel or lip would provide additional flexibility for positioning the drain grid 18 about an axis with respect to the drain throat 14, with less limitation for indexing the anchor supports S in reference to the anchor receiving channel and lip.

The drain grid 18 can vary in shapes or designs (e.g. square, rectangular, round, oval, triangular, diamond etc.), to be supported by the underlying tile frame 15 and drain throat 14. The drain grid may have perforation styles or patterns that provide aesthetic appeal without compromising fluid flow therethrough. The drain grid 18 includes specifically designed anchoring support structures S (e.g., machined areas) on the underside (i.e., the side not exposed to view when installed in the floor, or the side facing the drain throat 14). The anchor supports S facilitate attaching the drain grid 18 to the drain throat 14, by means of single or multiple substantially concealed lugs, set screws, posts, pins or other anchoring devices, to create a secure drain grid installation with no visible screws (FIG. 5). For purpose of the present invention, a structure is substantially concealed from plain view from a direct view perspective squarely (e.g., in a perpendicular direction) at the drain grid 18.

With a complementary drain throat 14 having discontinuous lips L in a matching circumference, the anchoring supports S are arranged in a circle on the non-exposed side of the drain grid 18, to match the circular slightly flared opening in the drain throat 14. (If the opening of the drain throat is not circular, the anchor supports would be arranged in a matching profile.) In the illustrated embodiment, there are four anchoring supports S. There may be as many anchoring supports as the complementary anchoring receiving structures (i.e., lips L and/or sections of channel C) on the drain throat 14. Alternatively, there may be non-matching number of anchoring supports and anchoring receiving structures. For example, there may be more than one anchoring support structures S, for each complementary annular lip L or channel C. For a circular drain grid, this would allow the drain grid to be installed in an infinite number of planar orientations about the drain axis.

Figure 8A:
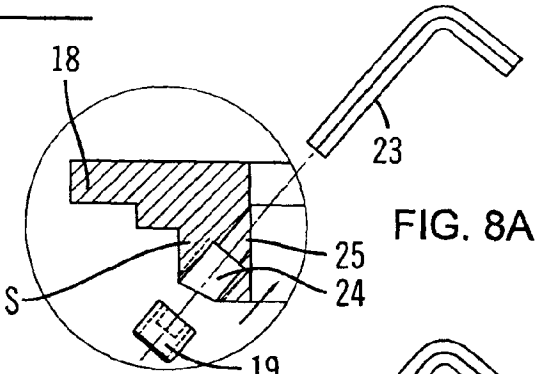
FIGS. 8A-8C are enlarged views illustrating the steps for installing the drain grid to the drain throat, in accordance with one embodiment of the present invention.
Figure 8B:
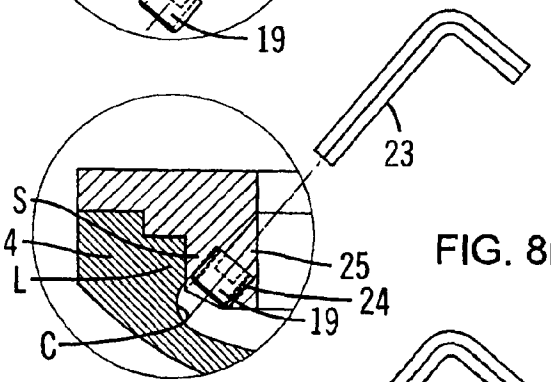
Figure 8C:
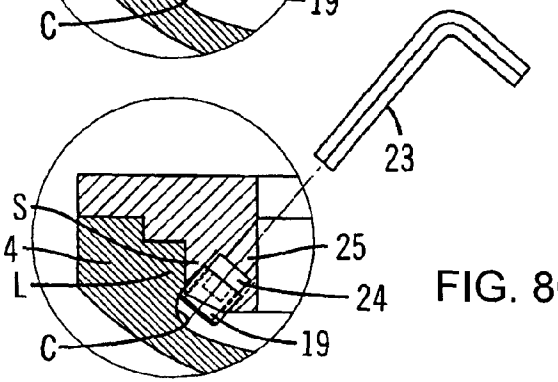
Figure 6B:
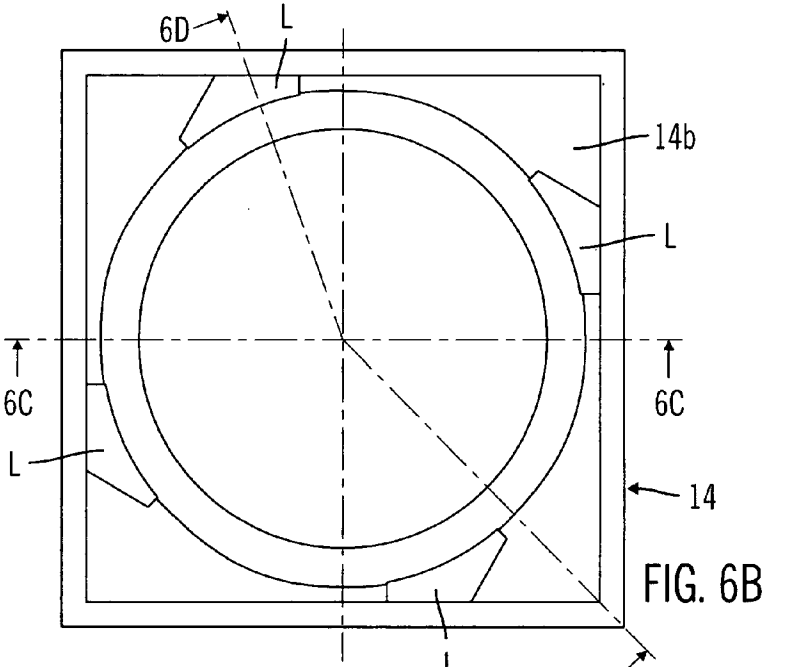
FIG. 6B is a top view of the drain throat in FIG. 6A.
Figure 6D:
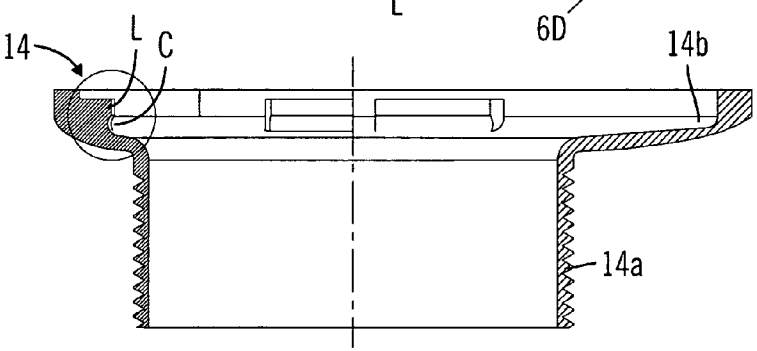
FIG. 6D is a sectional view taken along line 6D-6D in FIG. 6B.
Figure 6A:
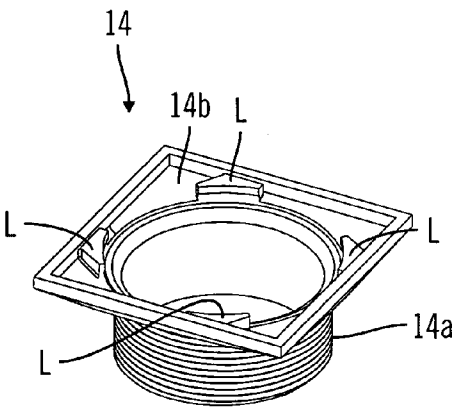
FIG. 6A is a perspective view of the of a drain throat in accordance with one embodiment of the present invention.
Figure 6C:
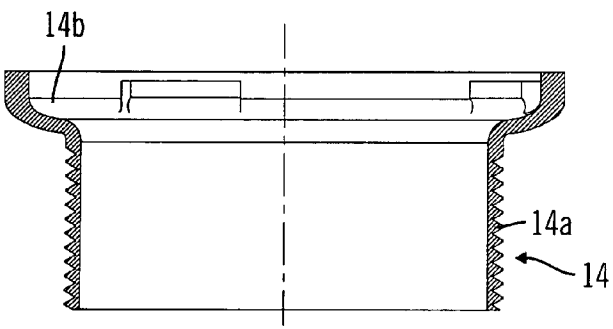
FIG. 6C is a sectional view taken along line 6C-6C in FIG. 6B.
Figure 9:
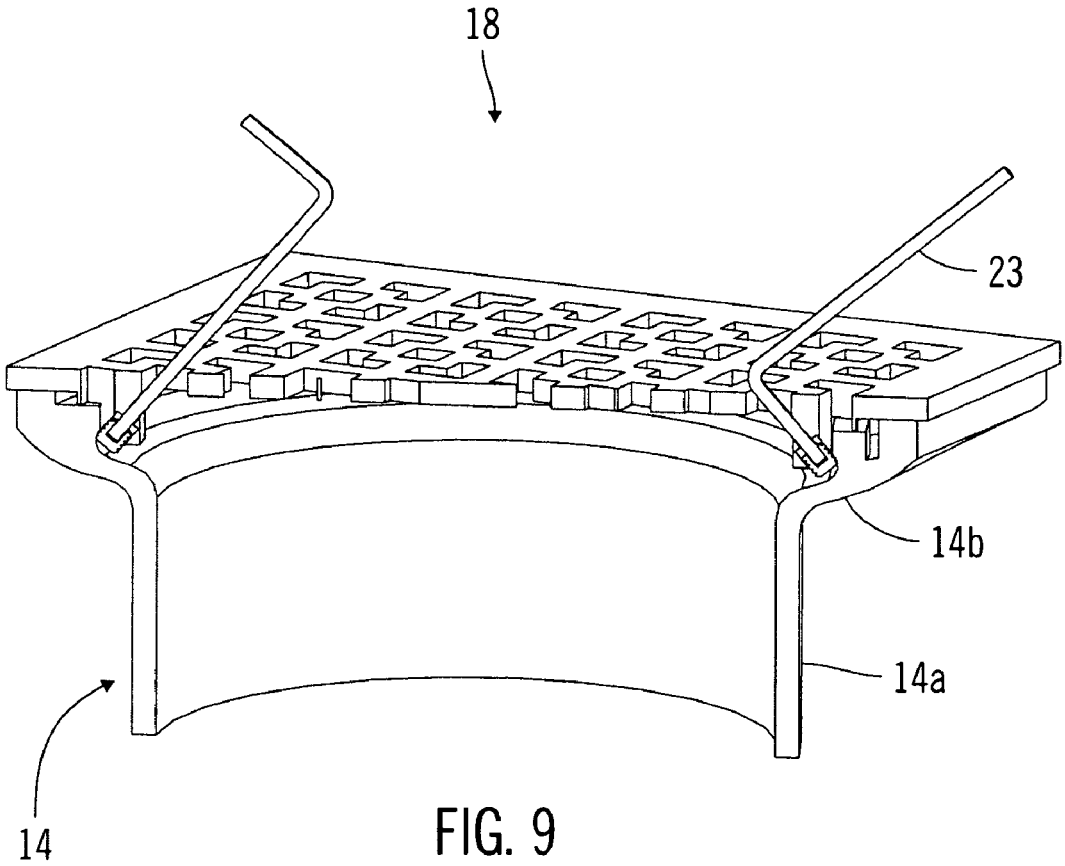
FIG. 9 is a sectional perspective illustrating access to the anchor supports on the drain grid during installation.

The anchoring support structure S illustrated supports the anchoring means (e.g., set screws) in an oblique angle with respect to the plane (or exposed surface) of the drain grid 18. The drain grid (with substantially concealed set screw, set screws, lugs, posts, pins or other anchoring devices) enables easy service access through the grid openings within the confines of the surface area of the drain grid, as illustrated in FIGS. 8 and 9. FIG. 8 illustrates an example of an anchor means, in the form of a set screw 19. The set screw 19 is screwed (backed) into a threaded hole 24 in the anchor support S prior to placing the drain grid on the drain throat 14. The set screw 19 is aligned with the channel C, beyond the lip L. A tool, such as an Allen wrench 23 is inserted through an opening in the drain grid 18 adjacent or near the anchor support S, and through a clearance hole 25 to turn the set screw to extend it into the channel C, thus locking the drain grid 18 from dislodging from the drain throat. As can be appreciated, the top side of the drain grid 18 is free from any opening for anchor structure. No anchor structure or other surface features is exposed at the top side of the drain grid 18. The anchor support S is hidden below the structure of the drain grid 18, with the support structure S not visible at the top surface of the drain grid 18 (the surface of the support structure is below the top surface of the drain grid 18, and it is only visible indirectly at an angle through the opening in the drain grid 18). It is contemplated within the scope and spirit of the present invention, to provide anchor supports that may be partially visible from direct square view from the first side through an opening in the drain grid. As long as the anchor support is submerged below the top surface (i.e., the exposed side after installation) of the drain grid, the aesthetics of the drain grid is significantly improved even if part of an anchor support is visible through the opening of the drain grid. The anchor support would be nonetheless deemed to be substantially concealed from view.

Alternatively, the axis of the anchoring means may be oriented parallel to the planar surface of the drain grid. The assembly and installation of the drain assembly in the floor would be within the skill of a professional installer given the disclosure herein.

Alternative to the illustrated embodiment, instead of using a channel C as an anchor receiving structure, a complementary internally threaded hole may be provided on the drain throat 14 for receiving the set screw 19 from the drain grid 18. However, this would require proper indexing of the anchor supports S on the drain grid 18 in relation to the anchor receiving holes in the drain throat 14. Further alternatively, instead of using a separate anchor means such as a set screw, the anchoring support structure may be structured in the shape of a hook or L-shaped structure extending from the underside of the drain grid. Several such anchoring structures may be provided, arranged in a circle under the plane of the drain grid. With a complementary drain throat having discontinuous lips L in a matching circumference, the drain grid may be attached to the drain throat by twisting or rotating the drain grid with respect to the drain axis, such that the hook or L-shaped anchoring structures latch onto the lips L with the tips of the hooks or L-shaped structures in the channels C on the drain throat. The anchoring structures (hooks and/or L-shaped structures) may be made flexible to facilitate mating of these structures against the channels and lips on the drain throat.

The various components of the drain assembly disclosed herein may be substantially rigid, or made flexible. The various components may be made of metal or non-metallic materials (e.g., brass, copper, stainless steel, aluminum, plastic, etc.) or a combination of such materials, using various manufacturing processes (e.g. casting, forging, extruding, injection and/or machining). For example, the drain body 11, collar 12, drain throat 14, tile frame 15 and drain grid 18 may be made from the same or different metallic or non-metallic materials, using the same or different manufacturing processes for each component. Various waterproofing materials may be used for the membrane 33 (e.g. hot mopping with a tar or bitumen type material, or a rubberized, plastic or metallic type material). The drain pipe 20 can be formed of various materials (e.g., copper, ABS or PVC plastic to cast iron).

Figure 10:
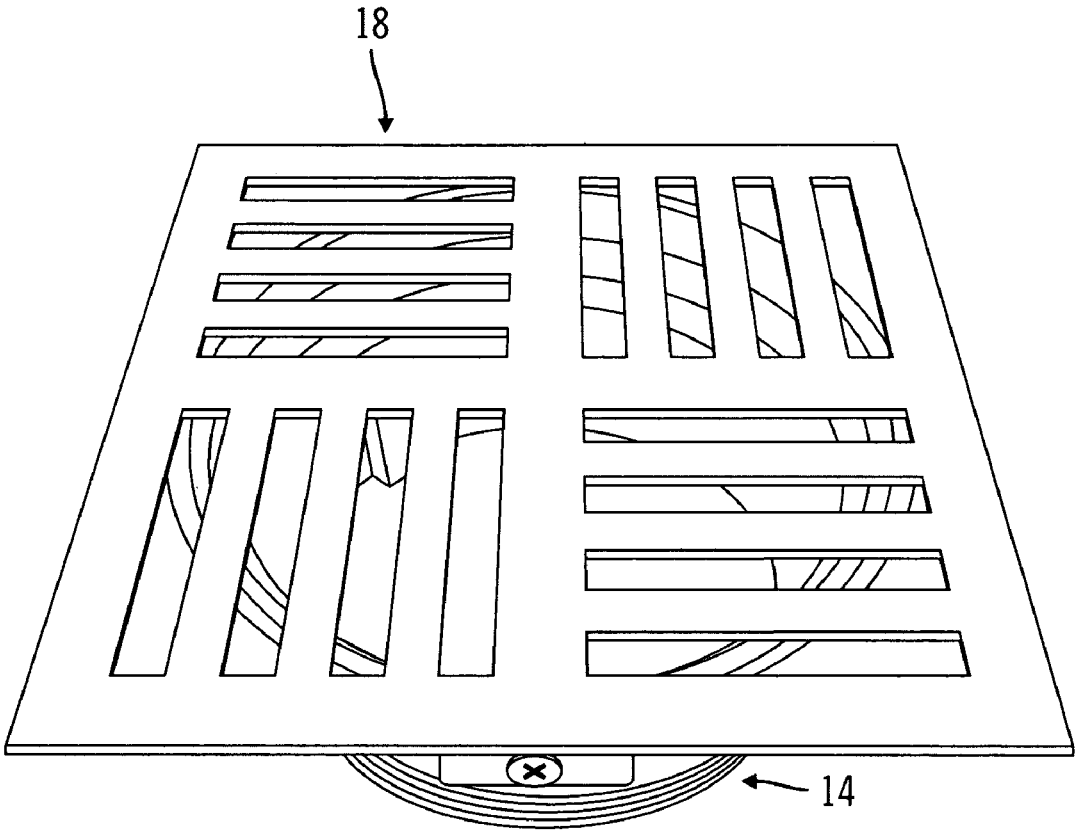
FIG. 10 illustrates a drain assembly after installation, in accordance with one embodiment of the present invention.

The substantially concealed drain grid anchoring structure in accordance with the present invention offers protection against risk of potential injury caused by raised screw heads or jagged screws on the exposed drain grid surface. FIG. 10 illustrates the drain assembly after installation, showing the smooth aesthetic appeal of the drain grid, free from holes or other visible features associated with anchoring means.

The drain grid can also take on other structures and shapes, depending on the application for which it may be used. Floor drain is one application but the purpose and definition of the present invention can be extended to incorporate applications for, e.g., HVAC and ventilation registers, or any type of fixture apertures requiring a decorative finish component such as a grid or perforated cover or cap, or a substantially closed cover, cap or face plate.

While the invention has been particularly shown and described with reference to the preferred embodiments, it will be understood by those skilled in the art that various changes in form and detail may be made without departing from the spirit, scope, and teaching of the invention. A person skilled in the art will recognize that the inventive capping structure can be used to cap various different types of conduits. Accordingly, the disclosed invention is to be considered merely as illustrative and limited in scope only as specified in the appended claims.

The invention claimed is:

1. A floor drain assembly, comprising:

a drain sub-assembly structured to be attached to an end of a drain pipe, wherein a drain opening is defined for flow of fluid, and wherein the drain sub-assembly comprises a drain body, a collar attached to the drain body, and a drain throat attached to the collar by a threaded coupling for adjustment of height of the drain throat with respect to the drain collar;

a perforated plate covering the drain opening, wherein the perforated plate has a first side exposed to external view after installation to the drain sub-assembly, and a second side not exposed to external view after installation to the drain sub-assembly; and at least one anchor support extending from, unitary and integral with the second side of the perforated plate, and wherein the anchor support is substantially concealed from plain view from a direction squarely from the first side of the perforated plate, and wherein the anchor support is structured to support an anchor at an oblique angle with respect to the first side of the perforated plate for attachment of the perforated plate to the drain sub-assembly, wherein the drain sub-assembly comprises an interior channel defined by a lip at the periphery of the drain opening receiving the anchor selected from the group consisting of screws, lugs, posts and pins.

2. The floor drain assembly as in claim 1, wherein the anchor is accessible from the first side of the perforated plate through perforation therein to extend the anchor into the interior channel in the drain sub-assembly.

3. The floor drain assembly as in claim 1, wherein there are multiple anchor supports distributed and arranged in a profile complementing the interior channel in the drain sub-assembly.

4. The floor drain assembly of claim 1, wherein the anchor support supports the anchor entirely below the first side of the perforated plate.

5. The floor drain assembly as in claim 1, wherein the anchor is accessible by a tool from the first side of the perforated plate, and the internal channel receives a tip of the anchor.

* * * * *